US006865865B2

(12) United States Patent
Hannen et al.

(10) Patent No.: US 6,865,865 B2
(45) Date of Patent: Mar. 15, 2005

(54) APPARATUS FOR WRAPPING A STACK OF OBJECTS

(75) Inventors: Reiner Hannen, Kalkar-Wissel (DE); Norbert Vermeulen, Kieve-Warbeyen (DE)

(73) Assignee: Msk-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

(21) Appl. No.: 10/470,185

(22) PCT Filed: Jan. 23, 2002

(86) PCT No.: PCT/EP02/00633

§ 371 (c)(1),
(2), (4) Date: Jul. 24, 2003

(87) PCT Pub. No.: WO02/058997

PCT Pub. Date: Aug. 1, 2002

(65) Prior Publication Data

US 2004/0107677 A1 Jun. 10, 2004

(30) Foreign Application Priority Data

Jan. 25, 2001 (DE) ..... 201 01 909 U

(51) Int. Cl.[7] ..... B65B 9/10

(52) U.S. Cl. ..... 53/567; 53/576

(58) Field of Search ..... 53/459, 556, 567, 53/576

(56) References Cited

U.S. PATENT DOCUMENTS 4,064,678 A * 12/1977 Grocke ..... 53/567
6,032,439 A * 3/2000 Birkenfeld et al. ..... 53/567

FOREIGN PATENT DOCUMENTS

DE 19732298 * 2/1999
EP 0564971 * 3/1993

* cited by examiner

*Primary Examiner*—John Sipos
(74) *Attorney, Agent, or Firm*—Herbert Dubno; Andrew Wilford

(57) ABSTRACT

An apparatus for wrapping an object with a stretchable foil hood has a pair of gathering fingers engageable upwardly into the foil hood, two gathering wheels outside the foil hood, rotatable about gathering-wheel axes, and engageable with the hood, and respective counter rolls inside the foil hood, aligned with the gathering wheels to pinch the foil hood, and rotatable about counter-roll axes below the respective gathering-wheel axes. The gathering wheel are rotated while in contact with the foil to form the foil into downwardly and outwardly extending folds.

6 Claims, 2 Drawing Sheets

APPARATUS FOR WRAPPING A STACK OF OBJECTS

CROSS REFERENCE TO RELATED APPLICATIONS

This application is the US national phase of PCT application PCT/EP02/0633 filed 23 Jan. 2002, published 01 Aug. 2002 as WO 02/058997, and claiming the priority of German application 201 01 909.4 filed 25 Jan. 2001.

FIELD OF THE INVENTION

The invention relates to an apparatus for wrapping a stack of objects with at least one generally hood-shaped foil that is gathered on a gathering device and then outwardly stretched, in particular by a pull-down device movable along the stack, the gathering device comprising at least two gathering fingers and, oriented on a connecting line and normally on two opposite connecting lines between two adjacent gathering fingers, at least one roller assembly comprised of a gathering wheel engaging the outside of the foil and, confronting the gathering wheel, a counter roller engaging the inside of the foil and pinching the foil between itself and the gathering wheel, the foil being gathered by the roller assembly(s) on the gathering fingers like an accordion generally vertically.

BACKGROUND OF THE INVENTION

Such an apparatus gathers the foil longitudinally in accordion-like folds and then stretches it outward. When in this stretched condition, the gathering device with the accordions folded foil or the pull-down device, when the gathered foil has previously been transferred to one, is moved downward along the stack so that the gathered foil is expanded down over the stack. The gathered foil is here stretched after being transferred to the pull-down device.

In a known device in order to gather the foil there are, on opposite connecting lines between two adjacent gathering fingers, roller assemblies each formed by a gathering wheel and a counter roller. The gathering wheel is outside and the counter roller inside the foil so that the foil is pinched between the gathering wheel and the counter roller. The rotation axis of the counter roller is above the axis of the respective gathering wheel, that is toward the gathered end of the foil that is normally gathered vertically.

A disadvantage of this known apparatus is that the folds of the gathered end of the foil section do not always extend in the same orientation and all of the folds formed by gathering do not extend downward and outward, but instead are partly inward and downward. When a thus gathered foil is stretched and pulled down over the stack, it is not possible to pull down the foil uniformly, since the downwardly and outwardly directed folds hinder the movement of the downwardly and inwardly extending folds as result of the tension.

OBJECT OF THE INVENTION

It is therefore an object of the invention to improve on the above-described system so as to produce a problem-free gathering.

SUMMARY OF THE INVENTION

These objects are achieved in that, in order to form downwardly and outwardly extending folds, rotation axes of each gathering wheel and the respective counter roller are arranged such that a tangent extending through a contact point of each gathering wheel with the respective counter roller also extends downward and outward. This ensures that as a result of the inventive orientation of the rotation axis of the gathering wheel and the counter roller the foil is gathered into accordion folds that are always uniform and that extend downward and outward. As a result of this uniform fold formation the foil can easily be pulled down over the stack.

An advantage of such an apparatus is that the uniform orientation of the folds formed by gathering is effected without expensive equipment or a number of movable and service-intensive parts.

The stack to be wrapped can consist not only of stacked objects, e.g. bags, but can also be products of the white-machine trade, e.g. refrigerators, that are provided before wrapping with polystyrene corner protectors. It is also possible that the stack is on a pallet in which case the foil is pulled down over the pallet carrying the stack. The foil can be a premade custom tube section or a hood.

When the apparatus has a separate gathering device and pull-down device, the foil section gathered in accordion folds is set on holder elements of the pull-down device. The holder elements are then for example moved apart by a drive so that the foil is stretched outward. When in this condition the holder elements are moved downward or upward or the stack is moved downward or upward relative to the holder elements so that the gathered foil is pulled off the holder elements and left on the outside of the stack.

It is also possible that the gathering device not only gathers the foil, but also stretches and extends it. In this case the pull-down device is provided only for subsequently pulling the foil end over the stack.

When only two gathering fingers are provided, the distance between these opposite gathering fingers is somewhat greater than the distance between two opposite sides, preferably the narrow sides, of a stack to be wrapped. The roller assembly(s) can thus either be integrated in the gathering fingers or provided on a connecting line between the adjacent edges of opposite gathering fingers.

In a preferred embodiment of the invention the rotation axis of the gathering wheel is arranged at an angle of about 105° to the direction in which the foil extends.

Preferably the rotation axes of each gathering wheel and the respective counter roller of all the roller assemblies are oriented such that the tangents extending through the contact points between the gathering wheels and the respective counter rollers all extend downward and outward. This ensures that the foil is gathered fully into uniform downwardly and outwardly extending folds.

Preferably at least one of the gathering wheels is driven.

The diameter of at least one of the gathering wheels is larger than the diameter of the respective counter roller. This feature is recommended when the gathering device is also used as pull-down device. Since the counter rollers should not touch the stack when the foil is being pulled down, the foil does not need to be so greatly stretched due to the small diameters of the counter rollers.

It is advantageous when the gathering device has four gathering fingers, preferably formed as angled gathering wedges, provided at the four corners of a rectangular pallet.

When the distance between two adjacent gathering fingers is quite large at least two roller assemblies are arranged on a line between adjacent gathering fingers.

It is also possible for the gathering device also to serve as pull-down device movable along the stack. In this case the gathering device not only gathers the foil, but also stretches it simultaneously and pulls it over the stack. Of course in this case the gathering device is constructed along the stack. No separate pull-down device is needed.

BRIEF DESCRIPTION OF THE DRAWING

An embodiment of the invention is described in the following with reference to a drawing. Therein.

SPECIFIC DESCRIPTION

Figure 1:
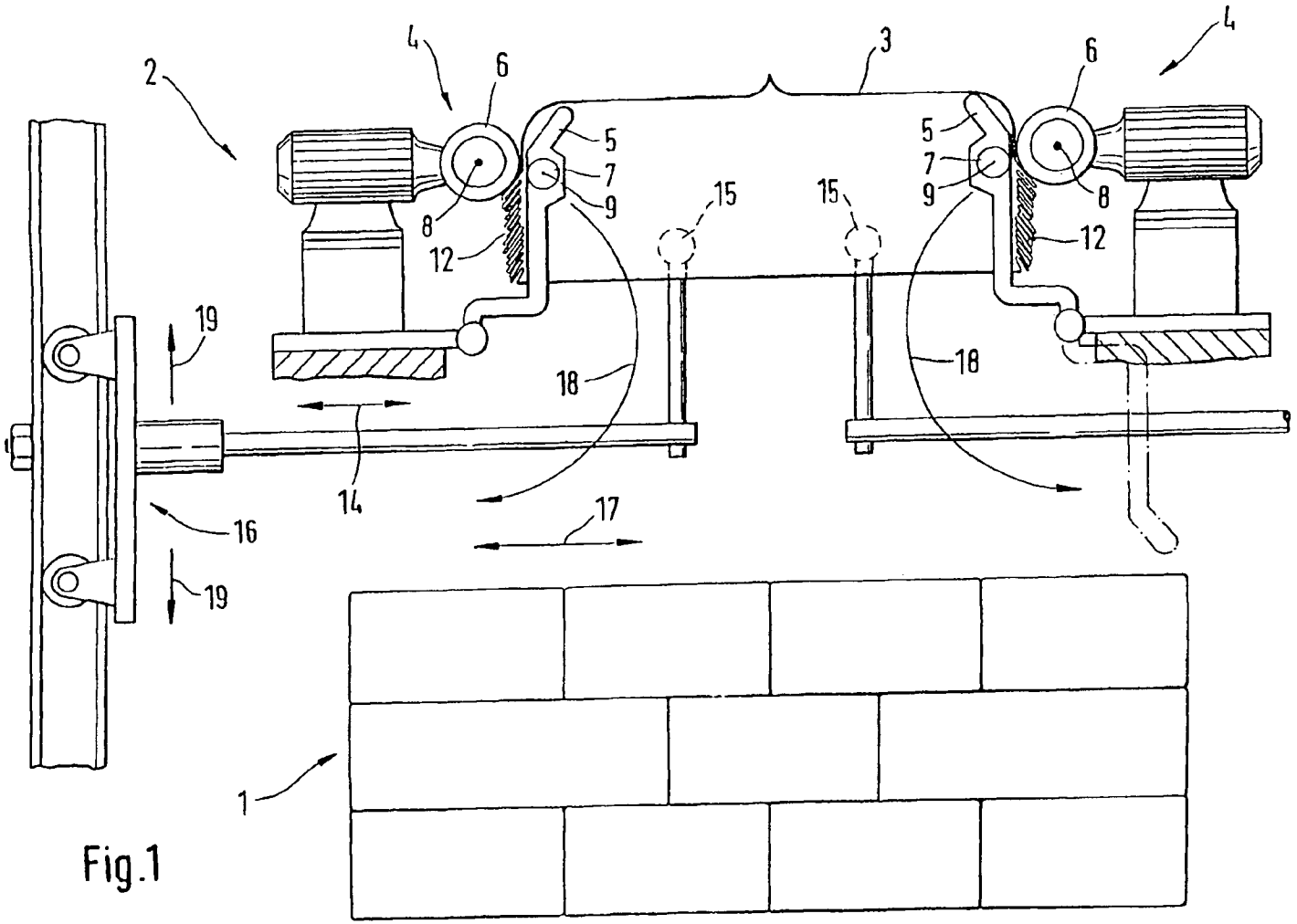
FIG. 1 is a side view of a stack of objects with a gathering device and a separate pull-down device.

In both figures the same or similar parts are assigned the same reference numerals.

FIG. 1 shows an apparatus having a gathering device 2 for wrapping a stack 1 of objects. In this case the object stack 1 is comprised of several packages. Of course it can be other objects, e.g. bags that are stacked on a pallet. It is also possible that the stack 1 could be a so-called white object, e.g. a washing machine, that is to be wrapped with a foil 3.

The gathering device 2 has a roller assembly 4 and pivotal gathering fingers 5 on opposite sides of the foil 3. These gathering fingers 5 project into the foil 3 and are inwardly angled at their upper ends toward the center of the stack 1.

Each roller assembly 4 is comprised of a gathering wheel 6 and a counter roller 7. The gathering wheel 6 is in contact with the outside of the foil 3 while the counter roller engages inside the foil 3. The counter roller 7 is rotatably mounted on the respective gathering finger 5. The foil 3 is pinched between each gathering wheel 6 and the respective counter roller 7 so that it is gathered in accordion-like folds 12 on the gathering fingers 5.

Figure 2:
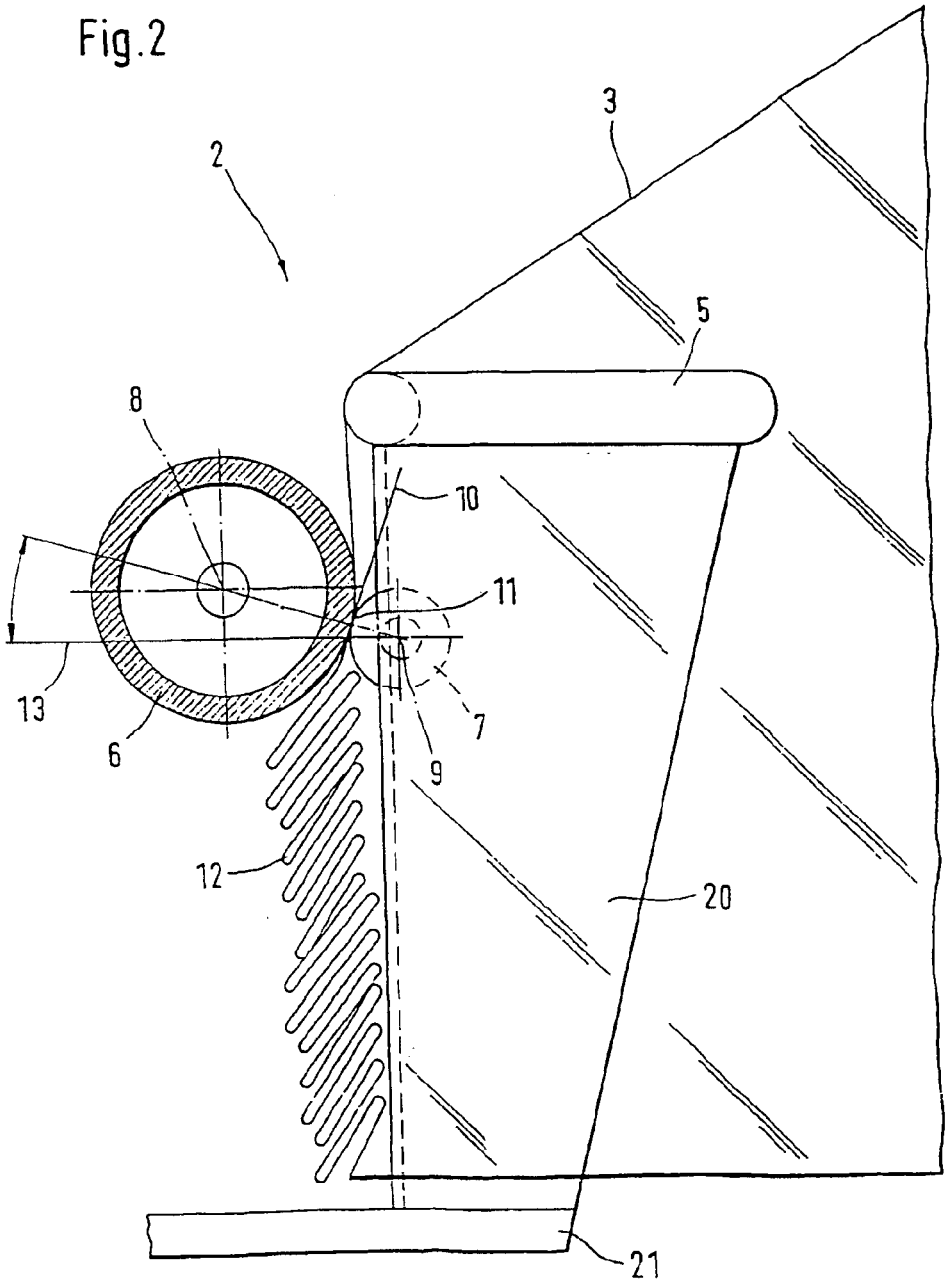
FIG. 2 is a detailed view of a roller assembly.

As clearly shown in FIGS. 1 and 2 rotation axes 8 of the gathering wheel 6 and rotation axes 9 of the respective counter rollers 7 of a roller assembly 5 are not at the same level. In fact the rotation axis 8 of each gathering wheel 6 is above the rotation axis 9 of the respective counter roller 7 so that a tangent 10 at a contact point 11 between the gathering wheel 6 and the respective counter roller 7 extends downward and outward. The effect of this is that the foil 3 is gathered in folds 12 and all of these folds 12 also extend downward and outward. An angle between the folds 12 and the direction in which the gathered foil 3 is stretched in the gathered and unstretched condition is between 20° and 60°, here 45°.

AS shown in particular in FIG. 2 the rotation axis of the gathering wheel 6 is on a line extending at an angle of 15° from a line 13 extending horizontally through the rotation axis 9 of the counter roller 7. Thus the angle between rotation axis 8 of the gathering wheel 6 to the stretch direction of the gathered foil 3 is about 105°.

As shown in FIGS. 1 and 2, the foil 3 is generally vertically gathered. It is also of course possible that the spacing of the gathering fingers 5 decreases for example downward, that is that they converge downwardly.

After gathering the foil 3, it is extended and stretched by shifting the fingers 5 of the gathering device as shown by arrow 14 so that the foil 3 is prestretched. The thus prestretched foil 3 is picked off by holder elements 15 of a pull-down device 16, these holder elements 15 being engaged inside the prestretched foil 3. After the holder elements 15 are moved apart in the direction of arrow 17 inside the gathered and prestretched foil 3, the gathering fingers 5 swing out of the way in the direction of arrows 18. The gathering device 16 is then moved with the foil 3 in the direction of arrow 19 downward along the stack 1. The closed upper end of the gathered foil 3 catches on the top of the stack 1 and the foil 3 is then pulled by the holder elements 15 downward and lies on the outside of the stack 1 and, if necessary, on any pallet carrying it.

It is also possible for the stretching and extending of the foil 3 to be done by the holder elements 15 of the pull-down device 16. In this case the gathering is done on the gathering fingers 5 of the gathering device, whereas the extending and stretching and the subsequent pulling-down of the foil 3 over the stack 1 are all done by the holder elements 15 of the pull-down device 16.

When a separate pull-down device 16 is not provided, the gathering device 2 is made movable along the stack 1 and the gathering device 2 gathers, stretches, and pulls down the foil 3.

FIG. 2 shows another embodiment of the gathering device 2. Here the gathering fingers 5 near the corners of the stack to be wrapped are horizontally extending L-shaped tubes or gathering wedges. Each gathering wedge is connected via an angled plate 20 with a profile 21 that is again fixed on an unillustrated movable slide.

As clearly shown, the tangent 10 at the contact point 11 between the gathering wheel 6 and the contact wheel 7 extends downward and outward so that as a result the folds 12 of the gathered foil 3 are similarly oriented.

As a result of the uniform arrangement of the folds 12, the foil 3 can be opened up without difficult fold 12 by fold 12 as it is pulled down over the stack 1 by the holder elements 15. In contrast to the prior-art apparatus where there is no rational ordering of the folds 12 and where the folds 12 extend outward and inward, the folds 12 are not drawn off uniformly (one outward, one inward).

The gathered foil 3 shown in FIGS. 1 and 2 is fed from above by an unillustrated foil-feeding or -making apparatus to the gathering device 2.

What is claimed is:

1. An apparatus for wrapping an object with a stretchable foil hood, the apparatus comprising:

a pair of gathering fingers engageable upwardly into the foil hood;

a gathering wheel outside the foil hood, rotatable about a gathering-wheel axis, and engageable with the hood;

a single counter roll inside the foil hood, aligned with the gathering wheel to pinch the foil hood, and rotatable about a counter-roll axis below the gathering-wheel axis; and means for rotating the gathering wheel while in contact with the foil to form the foil into downwardly and outwardly extending folds.

2. The wrapping apparatus defined in claim 1 wherein the axes are parallel and a line extending perpendicularly and downward from a line passing perpendicularly through both the axes extends outward from the foil hood.

3. The wrapping apparatus defined in claim 1 wherein the gathering wheel is of larger diameter than the counter wheel.

4. The wrapping apparatus defined in claim 1 wherein the apparatus has four-such gathering fingers formed as angled gathering wedges.

5. The wrapping apparatus defined in claim 1 wherein the apparatus has two such gathering wheels and two such respective counter rollers symmetrically flanking the foil hood.

6. The wrapping apparatus defined in claim 1 wherein the gathering fingers are displaceable downward along the stack.

* * * * *